US011659947B2

(12) United States Patent
Martinez

(10) Patent No.: US 11,659,947 B2
(45) Date of Patent: May 30, 2023

(54) SHOE HOLDER ORGANIZER

(71) Applicant: Bertha Stephanie Martinez, Upland, CA (US)

(72) Inventor: Bertha Stephanie Martinez, Upland, CA (US)

( * ) Notice: Subject to any disclaimer, the term of this patent is extended or adjusted under 35 U.S.C. 154(b) by 10 days.

(21) Appl. No.: 17/500,640

(22) Filed: Oct. 13, 2021

(65) Prior Publication Data

US 2022/0117423 A1 Apr. 21, 2022

Related U.S. Application Data

(60) Provisional application No. 63/092,091, filed on Oct. 15, 2020.

(51) Int. Cl.

| | |
|---|---|
| ***A47G 25/00*** | (2006.01) |
| *A47F 7/08* | (2006.01) |
| *A47F 5/08* | (2006.01) |
| *A47F 5/10* | (2006.01) |

(52) U.S. Cl.

CPC ..... *A47G 25/005* (2013.01); *A47F 5/08* (2013.01); *A47F 5/10* (2013.01); *A47F 7/08* (2013.01)

(58) Field of Classification Search

CPC ..... A47G 25/005; A47G 25/10; A47F 7/08; A47F 5/08; A47F 5/10; A47F 5/101; A47F 7/00; A47L 23/20; D06F 57/12

USPC ..... 211/34, 35

See application file for complete search history.

(56) References Cited

U.S. PATENT DOCUMENTS 1,890,131 A 6/1908 Fisher
1,383,597 A * 7/1921 Bruce ..... G01F 15/18 211/35
1,405,539 A * 2/1922 Moore ..... A47B 61/04 190/13 F
1,436,607 A * 11/1922 Roberts ..... A47L 23/16 15/267
1,583,646 A * 5/1926 Brennan ..... A47B 83/02 248/297.31
1,626,399 A * 4/1927 Fischer ..... A47F 7/08 211/35
1,949,017 A * 2/1934 Knupp ..... A47F 7/08 211/35
1,984,212 A * 12/1934 Hansen ..... A01J 1/00 297/178
1,990,418 A * 2/1935 Rostkowski ..... A43D 5/02 269/58
2,098,543 A * 11/1937 Handler ..... A47F 7/08 211/35

(Continued)

*Primary Examiner* — Devin K Barnett
(74) *Attorney, Agent, or Firm* — Kirk A. Buhler; Buhler & Associates Patenting

(57) ABSTRACT

Improvements in a shoe holder organizer is disclosed that allows the shoe holder to be mounted onto a vertical wall or door. The shoe holder organizer has a hinged door that can be easily grasped to pull down the door and gravity holds the door open, and a securing tab holds the door in the closed position. A flexible strap is included that folds with the door to provide a soft and flexible cushioned member that adds padding to the shoe holder, so damage is not caused to shoes that are stored on the shoe holder(s). There is further a vertical adjustment member that alters a distance from a clamping surface to the strap. There are a number of finite stops to position and retain the vertical adjustment member onto the wall mount bracket.

19 Claims, 6 Drawing Sheets

(56) References Cited

U.S. PATENT DOCUMENTS 2,110,232 A * 3/1938 Moore ..... A47F 7/08 211/180
2,117,630 A * 5/1938 Sapeer ..... A47F 7/08 211/35
2,189,366 A * 2/1940 Montague ..... A43D 3/1425 34/103
2,349,106 A * 5/1944 Mullan ..... A47L 23/18 15/268
2,535,755 A * 12/1950 Rieter ..... D06F 81/06 108/134
2,683,009 A * 7/1954 Kinsley ..... B65B 67/1205 248/168
2,778,705 A * 1/1957 Barker ..... D06F 57/12 312/313
3,173,826 A * 3/1965 Campbell ..... A47B 95/043 52/27
3,210,787 A * 10/1965 Allsop ..... A43D 3/1416 211/35
3,490,448 A * 1/1970 Grubb ..... A61F 13/0203 602/53
3,641,617 A 2/1972 Lopez
3,725,188 A * 4/1973 Kalt ..... A47B 95/043 206/326
3,865,338 A * 2/1975 Campbell ..... G01F 15/18 248/245
4,109,335 A * 8/1978 Randolph ..... A47L 23/18 15/267
4,483,039 A 11/1984 Breen
4,693,380 A * 9/1987 Muth ..... A47F 7/08 211/38
4,826,246 A * 5/1989 Meeker ..... B60N 2/2839 297/256.13
4,856,206 A * 8/1989 Klein ..... F26B 9/00 34/91
4,868,888 A * 9/1989 Dayton ..... H04R 5/023 455/344
4,995,681 A * 2/1991 Parnell ..... A47B 77/10 38/103
5,046,722 A * 9/1991 Antoon ..... A63B 17/00 482/41
5,136,746 A * 8/1992 Jones ..... A43D 3/025 12/124
5,137,240 A * 8/1992 Van Meter ..... A47G 25/845 248/240.4
5,143,177 A * 9/1992 Smith ..... A01M 31/02 182/136
5,405,189 A * 4/1995 Stumpf ..... A47C 7/402 297/410
5,562,180 A * 10/1996 Herzog ..... A01M 31/02 182/187
5,695,073 A 10/1997 Klein et al.
5,775,655 A * 7/1998 Schmeets ..... A47B 5/00 108/115
5,894,940 A 4/1999 Gusdorf et al.
5,992,648 A * 11/1999 Saunders ..... A47F 7/08 211/35
6,386,321 B1 * 5/2002 Muhich ..... A63B 27/00 182/135
6,544,639 B1 * 4/2003 Luhmann ..... C09J 7/26 428/347
6,680,096 B1 * 1/2004 Luhmann ..... C09J 7/10 428/40.1
6,845,541 B1 * 1/2005 Lai ..... A43D 3/02 15/267
7,159,324 B2 * 1/2007 Worrick, III ..... B65D 51/24 206/208
8,177,177 B2 * 5/2012 Ehrig ..... A01M 31/02 248/230.8
9,027,709 B2 * 5/2015 Wheelington ..... A01M 31/02 182/129
10,292,516 B1 * 5/2019 Lopez Rodriguez .. A47G 25/10
10,912,293 B1 * 2/2021 Miller ..... A01M 31/02
11,103,068 B1 * 8/2021 Koeppel ..... A47B 97/001
2002/0148685 A1 * 10/2002 Shan ..... A01M 31/02 182/187
2004/0075268 A1 * 4/2004 Manninen ..... A63C 11/2228 280/821
2006/0207833 A1 * 9/2006 Kessinger ..... A01M 31/02 182/187
2006/0214495 A1 * 9/2006 Glover ..... A44B 11/10 297/484
2007/0000726 A1 * 1/2007 Berkbuegler ..... A01M 31/02 182/187
2007/0095614 A1 * 5/2007 Mannor ..... A01M 31/02 182/187
2012/0199418 A1 * 8/2012 Priest ..... A01M 31/02 182/187
2014/0246963 A1 * 9/2014 Elizondo, Jr. ..... D06F 81/06 312/22
2014/0263516 A1 * 9/2014 Habberstad, Jr. ..... A01M 31/02 182/187
2016/0167748 A1 * 6/2016 Dias ..... B63B 32/83 211/85.7
2020/0268157 A1 * 8/2020 Eder ..... A47C 7/006
2020/0286411 A1 * 9/2020 Koeppel ..... G09F 15/0012

* cited by examiner

SHOE HOLDER ORGANIZER

CROSS REFERENCE TO RELATED APPLICATIONS

This application claims the benefit of Provisional Application Ser. No. 63/092,091 filed Oct. 15, 2020, the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a holder for shoes. More particularly, the present shoe holder organizer creates a multi-functional holder for shoes that allow the shoes to be held on a vertical wall to increase the storage area where shoes can be stored to efficiently store shoes.

Description of Related Art Including Information Disclosed Under 37 CFR 1.97 and 1.98

Closets are used to store clothing items and often shoes are placed under the hanging clothing. Placing the shoes on the ground or in shoe boxes that makes them difficult to locate and when the volume of shoes increases there needs to be storage in additional areas. Open areas of the walls, side panels, door and other flat surface provide additional storage areas that can be easily used with the right fixture. The correct fixture should be easily adaptable to the different types of shoes, including high heel shoes and should be easily secured and removed from a wall or door.

A number of patents and or publications have been made to address these issues. Exemplary examples of patents and or publication that try to address this/these problem(s) are identified and discussed below.

U.S. Pat. No. 5,894,940 issued on Apr. 20, 1999, to John Gusdorf et al., and is titled Vertical Wall Rack and Variable Shoe Holder Arrangement. This patent discloses a storage system having a pair of parallel, spaced side runners and a plurality of interchangeable wire racks secured and suspended between the side runners. The runners are mounted directly to a wall or other flat surface. The runners are provided in interlocking sections and can be joined together to form a runner if desired. Each runner has a plurality of evenly spaced openings formed along the length of a center section. One embodiment of the rack has a plurality of upward angled loops for holding a shoe. While this patent allows for the storage of shoes it can't be adjusted to fit different sizes of shoes.

U.S. Pat. No. 4,109,335 issued on Aug. 29, 1978, to Robert C. Randolph and is titled Shoe Support Apparatus. This patent discloses a shoe support apparatus, particularly for supporting a shoe thereon during the performance of a shoe shining operation, is disclosed. A base panel is adapted to be secured to a vertical support surface, such as, for example, a wall or a door. A shoe support member is pivotably mounted adjacent the lower portion of the panel. The sections are connected by unique pivot joints formed of integral parts of said sections and are so arranged as to define an over-center type locking mechanism. In this manner, the apparatus can be collapsed for storage and quickly erected and locked for rigidly supporting the shoe during a shoe polishing operation. This patent is only designed to hold shoes while they are being shined, it is not doesn't have a flexible strap nor a locking adjustment to hole a shoe onto the strap.

U.S. Pat. No. 3,641,617 issued on Feb. 15, 1972, to Pedro R. Lopez and is titled Adjustable Shoeshine Mount. This patent discloses a mounting bracket, an arm mounted therein and transverse thereto, a vertical support pivotally mounted at the other end of the arm, and a shoe frame mounted at the bottom of the support comprising sections pivotally and slidably connected to each other for securing and stretching the shoe to be polished. This patent is for a racket to shine shoes it is not a storage mechanism for different sizes of shoes or high-heel shoes.

What is needed is a shoe holder that can be easily mounted onto a wall or other flat surface, can be folded onto the wall, and has multiple adjustments to hold different size shoes and high-heel shoes. The proposed shoe holder organizer provides a storage system that allows for shoes to be held in a variety of configurations to increase the storage space in a closet or any space with a flat surface.

BRIEF SUMMARY OF THE INVENTION

It is an object of the shoe holder organizer to have securing methods that allows the shoe holder to be mounted onto a vertical wall. The shoe holder can be mounted with threaded fasteners like screws or can be secured with an adhesive that can be installed and removed from the wall without leaving a residue on the wall. A pull tab on the adhesive backing leases the bond between the shoe holder and the wall or door. The shoe holder can hold a single shoe, and multiple shoe holders can be used to store as many shoes as possible or pairs of shoes that are desired. Storing the shoes on a wall, door or other flat surface makes all the shoes visible without needing to search through a pile of shoes that are set on the floor or in boxes that are bulky and take away closet space.

It is an object of the shoe holder organizer to be able to fold the shoe holder against a wall for storage or when not needed to hold shoes. The door of the hinge can be easily grasped to pull down the door and gravity holds the door open, and a securing tab holds the door in the closed position. The door is configured to extend into a shoe, so the toe of the shoe faces away from the wall or door where the shoe holder is mounted. The door has a width that allows the door to easily fit with most shoes.

It is another object of the shoe holder organizer to have a strap that extends from the back wall mount to the door. The strap is flexible to easily fold within the shoe holder. The strap provides a soft and flexible cushioned member that adds padding to the shoe holder, so damage is not caused to shoes that are stored on the shoe holder(s). The strap has some elastic properties that allows the strap to stretch and conform around the shape of a shoe. The strap is secured at a first end on the back member and at a second end on the door to allow the strap to fold in and out of the shoe holder as the door is opened and closed.

It is still another object of the shoe holder organizer to have a vertical adjustment member that alters a distance from a clamping surface to the strap. There are a number of finite stops to position and retain the vertical adjustment member onto the wall mount bracket. A user squeezes both sides of the vertical adjustment member to dis-engage the locking mechanism or fingers of the vertical adjustment mechanism to slide the vertical adjustment mechanism along the back member. The vertical member can slide onto the heel of a shoe to securely hold the shoe to prevent the shoe from accidentally being dislodged from the shoe holder. The shoe is stored with the heel facing up to prevent any dust or debris from entering the shoe.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
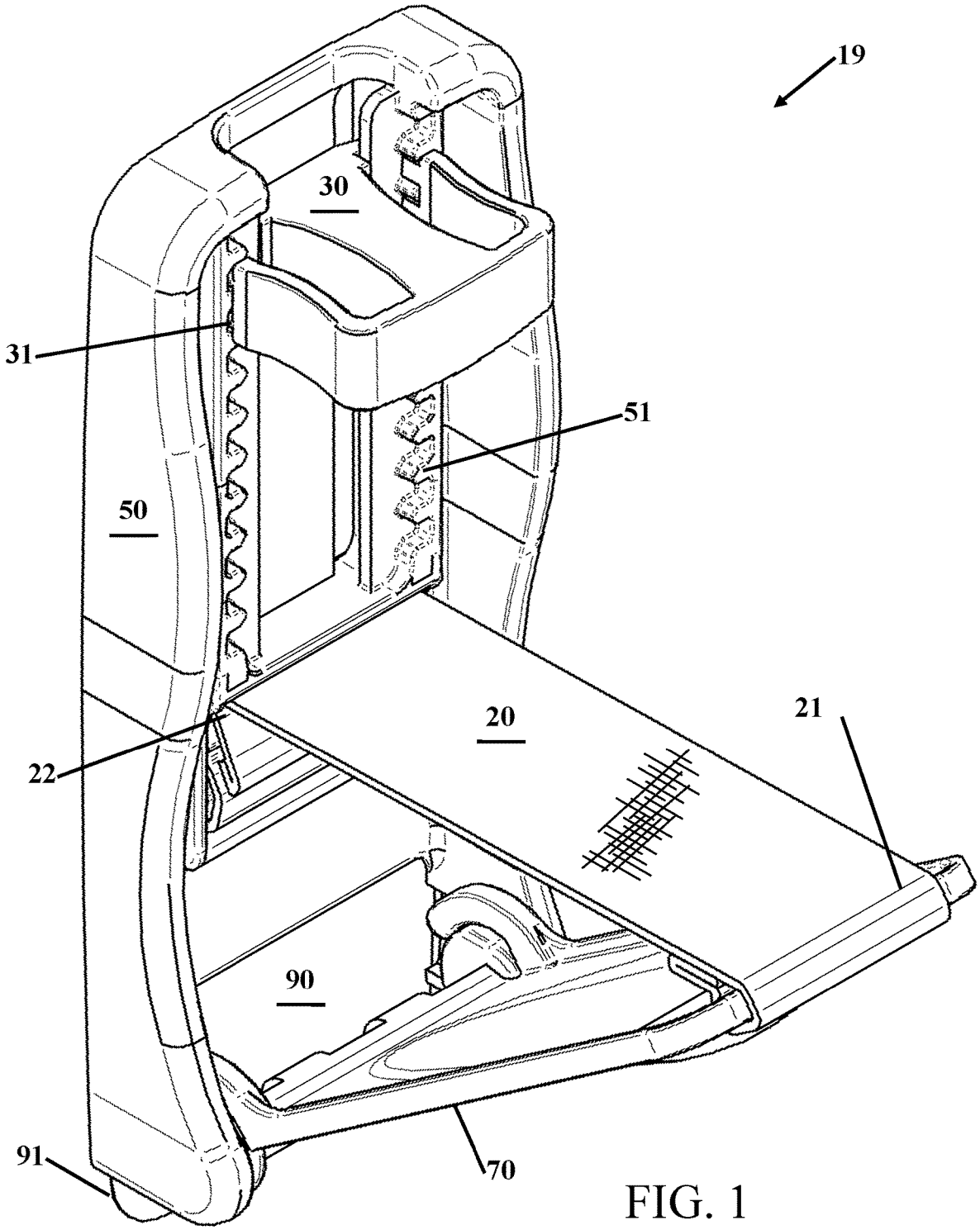
FIG. 1 shows a perspective view of a shoe holder organizer.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention but is merely representative of various embodiments of the invention. The illustrated embodiments of the invention will be best understood by reference to the drawings, wherein like parts are designated by like numerals throughout.

ITEM NUMBERS AND DESCRIPTION

| | |
|---|---|
| 17 heel | 18 shoe |
| 19 shoe holder organizer | 20 flexible strap |
| 21 first end | 22 second end |
| 23 strap | 30 cushion |

-continued

| | |
|---|---|
| 31 tab(s) | 32 flex arm(s) |
| 33 hinge | 34 outer wall |
| 35 upper wall | 39 cushion moved |
| 50 wall mount bracket | 51 teeth |
| 52 hinge rod | 53 stop |
| 54 side wall | 55 inner wall |
| 56 strap lock (bracket) | 57 upper wrap tab |
| 58 lower wrap tab | 59 detent |
| 60 close detent | . |
| 70 door | 71 hinge socket |
| 72 stop tab | 73 travel arm |
| 74 strap lock (door) | 75 opening |
| 76 finger tab | 77 door wall. |
| 90 adhesive backing | 91 pull strip |
| 92 openings | 97 down |
| 98 squeeze | 99 move |

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated. The terminology used herein is for the purpose of describing particular embodiments only and is not intended to be limiting of the technology. As used herein, the singular forms "a," "an," and "the" are intended to include the plural forms as well, unless the context clearly indicates otherwise.

It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof. It will be understood that like or analogous elements and/or components, referred to herein, may be identified throughout the drawings with like reference characters.

FIG. 1 shows a perspective view of a shoe holder organizer 19. The shoe holder organizer 19 is shown with a wall mount bracket 50 or rear housing. The wall mount bracket 50 is the main housing for the shoe holder organizer 19. Through an opening in the bottom of the wall mount bracket 50 a portion of an adhesive backing 90 can be seen. The adhesive backing 90 allows the shoe holder organizer 19 to mount onto a wall without using fasteners, such as screws or nails. While the preferred mounting of the shoe holder organizer 19 is with an adhesive pad because it leaves no hole in a wall, fasteners can be used. The adhesive backing has a release liner that is removed from the back of the shoe holder organizer 19 and the shoe holder organizer 19 can be "pressed" onto a wall, door, or other surface so the adhesive in the adhesive backing 90 will hold the shoe holder organizer 19 onto the surface. The adhesive backing 90 has a pull strip 91, whereby a user can "pull" on the pull strip 91 to release the shoe holder organizer 19 from the surface without leaving a residue or adhesive on the surface. The adhesive backing 90 is preferably shaped to cover the entire back surface of the wall mount bracket 50 and has some cushion to contour to surface topography where the shoe holder 19 is adhered.

A door 70 hinges from the bottom of the wall mount bracket 50. The door 70 is limited in rotation by a flexible strap 20. The flexible strap 20 connects at a first end 21 to the movable end of the door 70 and at a second end 22 to the wall mount bracket 50. The flexible strap 20 is preferably a woven material and provides a cushion to a stored shoe and can conform around a portion of a shoe held with the shoe holder organizer 19. At the top of the wall mount bracket 50 is a vertical adjustable member 30. The vertical adjustable member 30 has a plurality of tab(s) 31 that engage in teeth 51 in the wall mount bracket 50. The combination of tab(s) 31 and teeth 51 allows the vertical adjustable member 30 to be positioned on the wall mount bracket 50 to adjust and secure a shoe therein.

Figure 2:
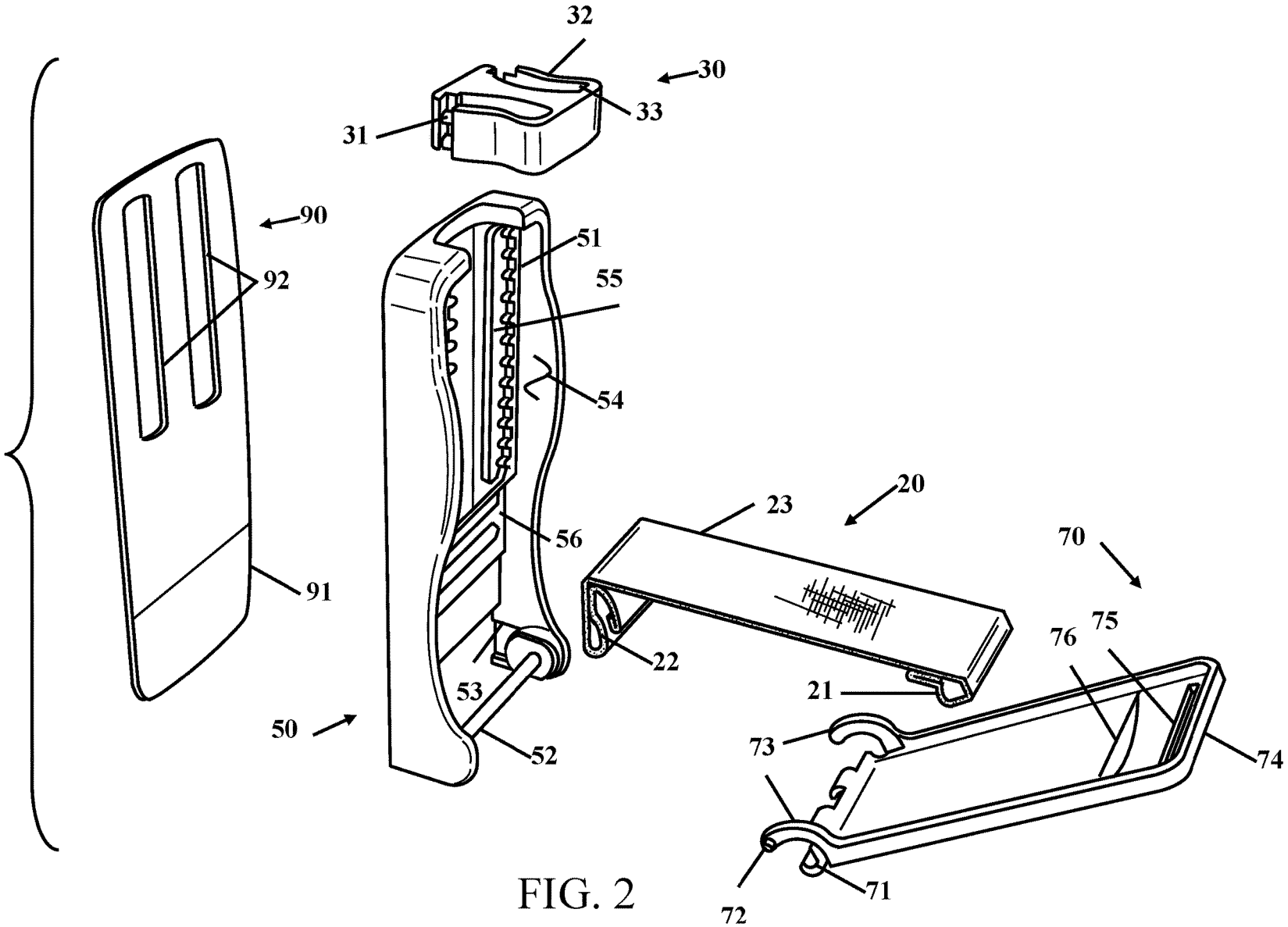
FIG. 2 shows an exploded view of the shoe holder organizer.

FIG. 2 shows an exploded view of the shoe holder organizer 19. Starting with the adhesive backing 90 that is bonded or otherwise secured to the back of the wall mount bracket 50. The adhesive backing 90 has a plurality of holes 92 that are clearance for the back of the wall mount bracket 50. At the bottom of the adhesive backing is a pull strip 91 that is pulled to release the adhesive bond between the wall mount bracket 50 and a wall. In this view, the wall mount bracket 50 shows the plurality of teeth 51 where the tab(s) of the cushion 30 engage. A user can "squeeze" the flex arms 32 of the cushion to bend the hinge 33 of the cushion 30 to dis-engage the tabs 31 and slide the cushion 30 on an inner wall 55 of the wall mount bracket 50. The cushion 30 slides within the side walls 54 of the wall mount bracket 50.

Below the teeth 51 of the wall mount bracket 50 are some strap lock 56 features where the second end 22 of the flexible strap 20 can wrap around to secure the strap 23 onto the wall mount bracket 50. At the lower portion of the wall mount bracket 50 is a hinge rod 52 where the hinge socket 71 of the door 70 is retained. Also, in the lower portion of the wall mount bracket 50 there is a stop 53 there the stop tab 72 on the travel arm 73 this is shown and described in more detain in FIG. 4. At the opposing end of the door 70 the finger tab 76 is shown along with an opening 75 and a strap lock 74 where the first end 21 of the flexible strap 21 is retained.

Figure 3:
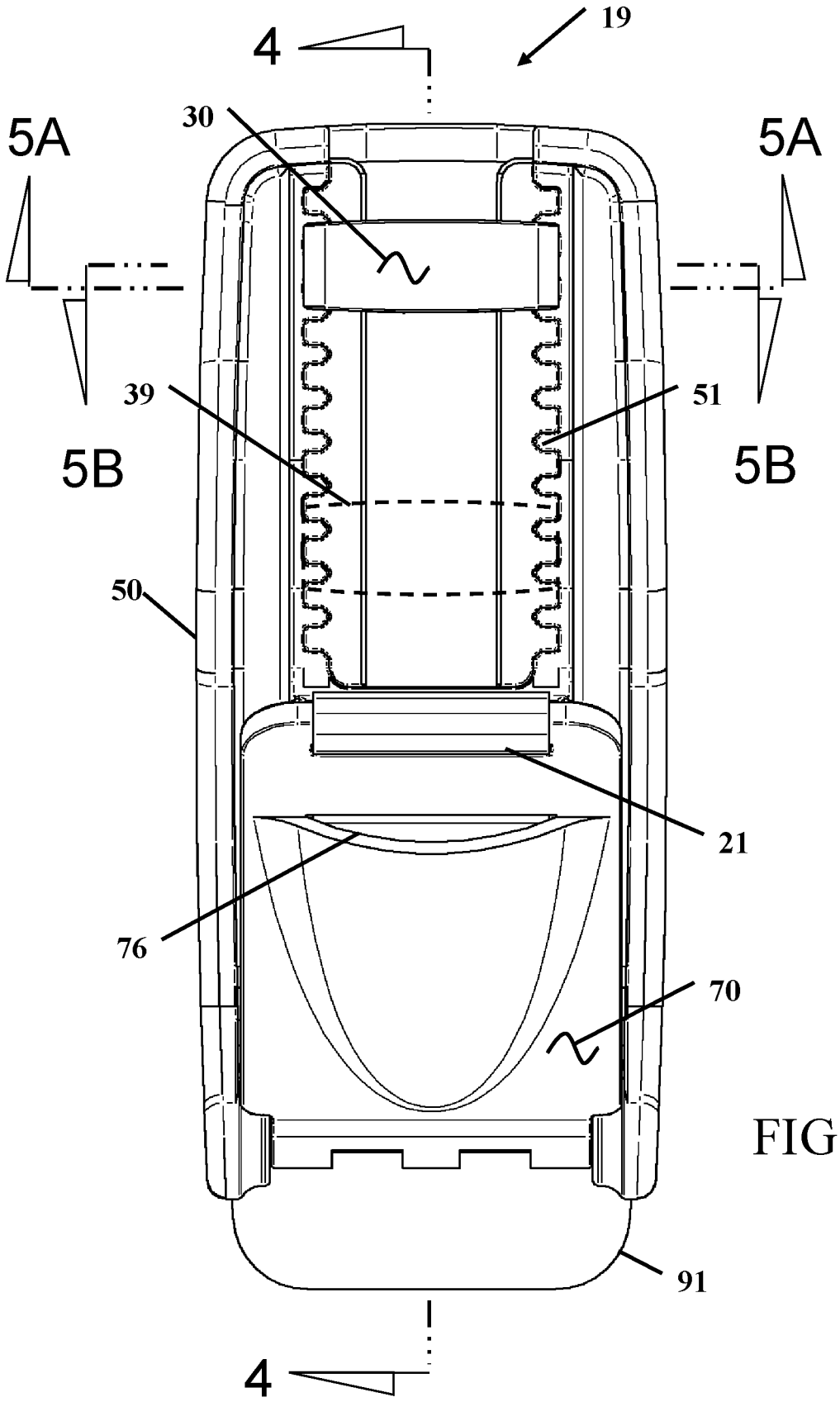
FIG. 3 shows a plan view of the shoe holder organizer.
Figure 4:
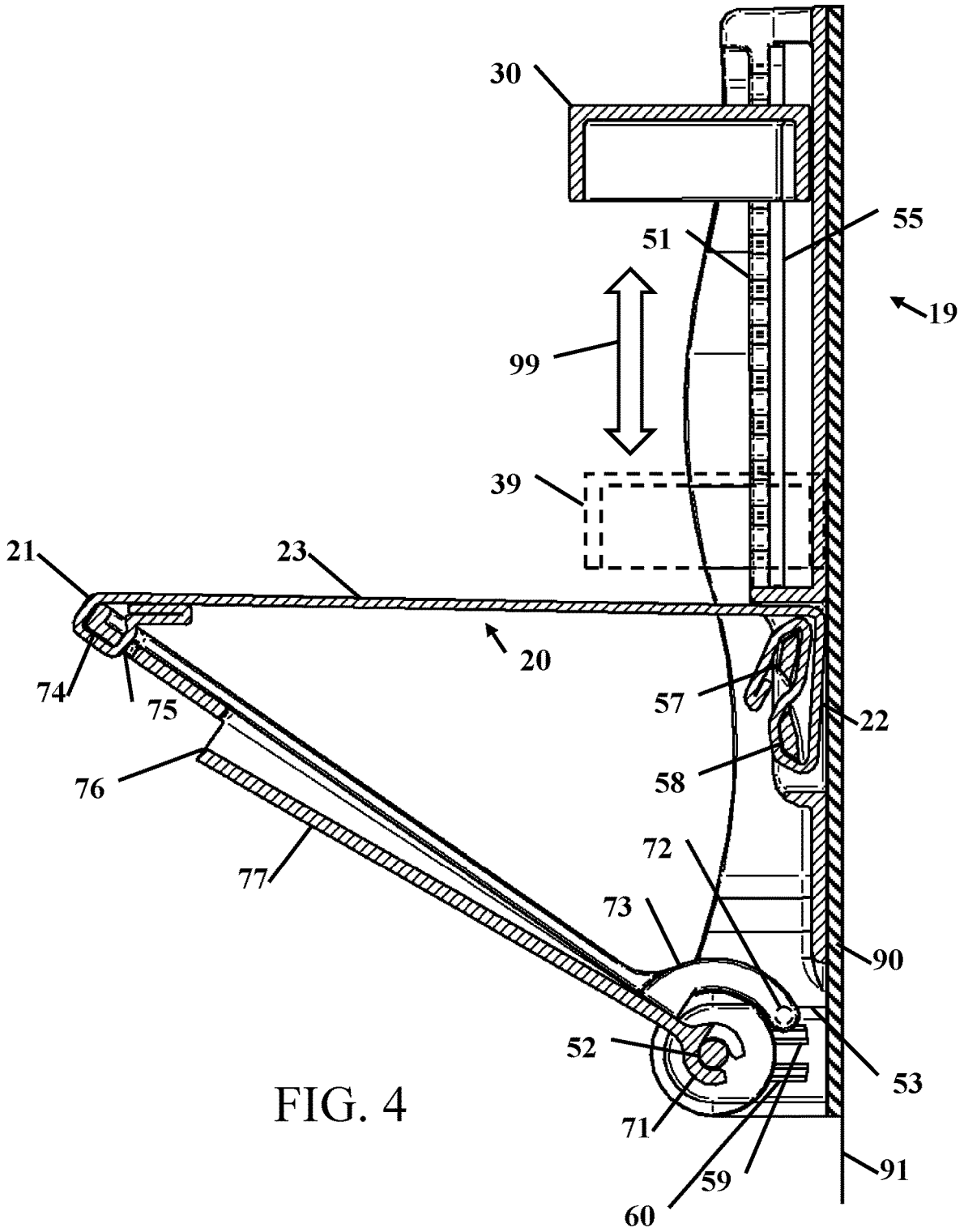
FIG. 4 shows a right-side sectional view taken along lines 4-4 from FIG. 3.
Figure 5B:
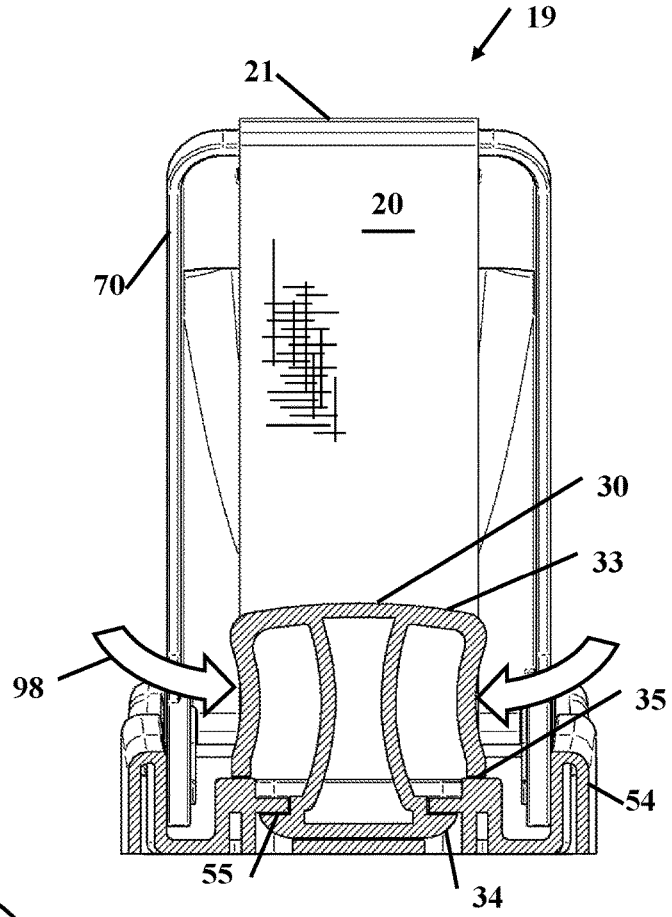
FIG. 5B shows a top sectional view taken along lines 5B-5B from FIG. 3.
Figure 5A:
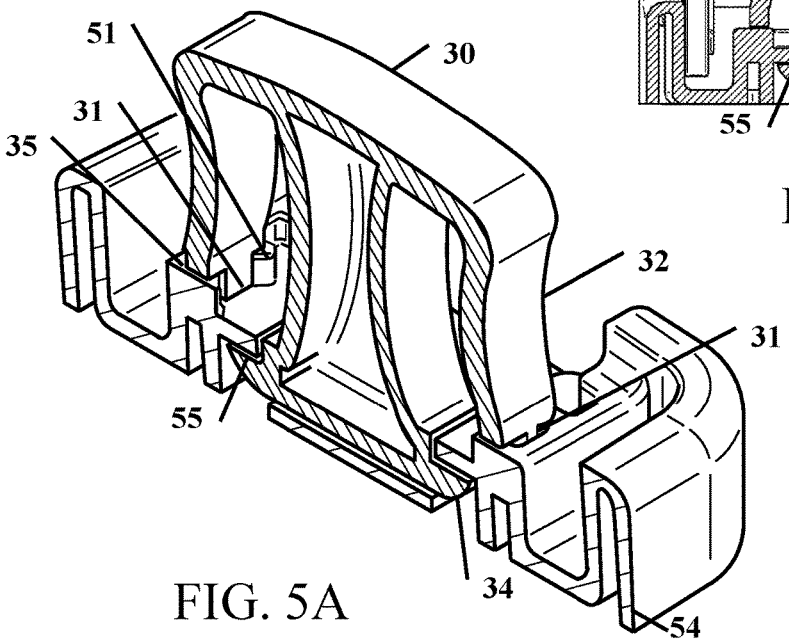
FIG. 5A shows a bottom sectional view taken along lines 5A-5A from FIG. 3.

FIG. 3 shows a plan view of the shoe holder organizer 19 this plan view provides a reference orientation for the sectional views shown in FIGS. 4, 5A and 5B. In this figure, the wall mount bracket 50 is shown on the adhesive backing with the pull strap extending out the bottom of the wall mount bracket 50. The door 70 is in an open orientation with rotation of the door 70 held in limited rotation with the flexible strap 20. The first end 21 of the flexible strap 20 is shown secured to the end of the door 70. The finger tab 76 is visible in this figure. A user can use the finger tab 76 to easily grasp the door 70 to open the door 70. The wall mount bracket 50 has multiple teeth 51 for positioning and locking the cushion 30. A second position of the cushion moved 39 is shown with the cushion 30 in broken line.

FIG. 4 shows a right-side sectional view taken along lines 4-4 from FIG. 3. Starting from the far-right side of this figure the pull strip 91 shown on the adhesive backing 90 on the wall mounting bracket. The cushion 30 is shown in an upper position and in a lower position as broken lines with the cushion moved 39. The cushion 30 can be moved 99 and located in any fixed position on the teeth 51. The cushion 30 tracks on the inner wall 55. The flexible strap 20 is shown with the strap 23 extending between the first end 21 that is secured around the strap lock 74 through the opening 75, to the second end 22 where the strap is wrapped around an upper wrap tab 57 and a lower wrap tab 58.

The door shows the finger tab 76 and the wall 77 of the door. The hinge socket 71 of the door is secured onto the hinge rod 52. The outermost travel of the door is stopped when the stop tab 72, on the travel arm 73, contacts the stop 53. The rotation of the door is held closed by a close detent 60 and at a position between opened and closed by a middle detent 59 to temporally hold the door in fixed positions.

FIG. 5A shows a bottom sectional view taken along lines 5A-5A from FIG. 3, FIG. 5B shows a top sectional view taken along lines 5B-5B from FIG. 3. The door 70 is shown secured by the flexible strap 20 at the first end 21. These figures mostly show the operation and interaction of the cushion 30 in the shoe holder 19. The cushion 30 has tab(s) 31 that engage into teeth 51 in the wall mount bracket to retain the cushion 30 in finite positions. A user squeezes 98 the sides of the cushion 30 to depress the flex arms 32 on the hinge 33 to disengage the tab(s) 31 from the teeth 51. The cushion 30 is constrained within the side wall(s) 54 to slide within the wall mount brackets with the upper wall 35 and the outer wall 34 tracking on the inner wall 55 for the purpose of adjusting to the heel width and height.

Figure 6:
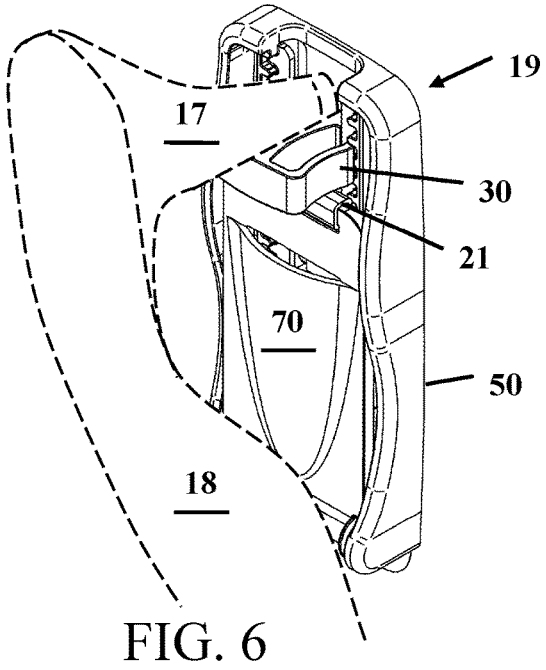
FIG. 6 shows a perspective view of the show holder organizer in the closed orientation.
Figure 7:
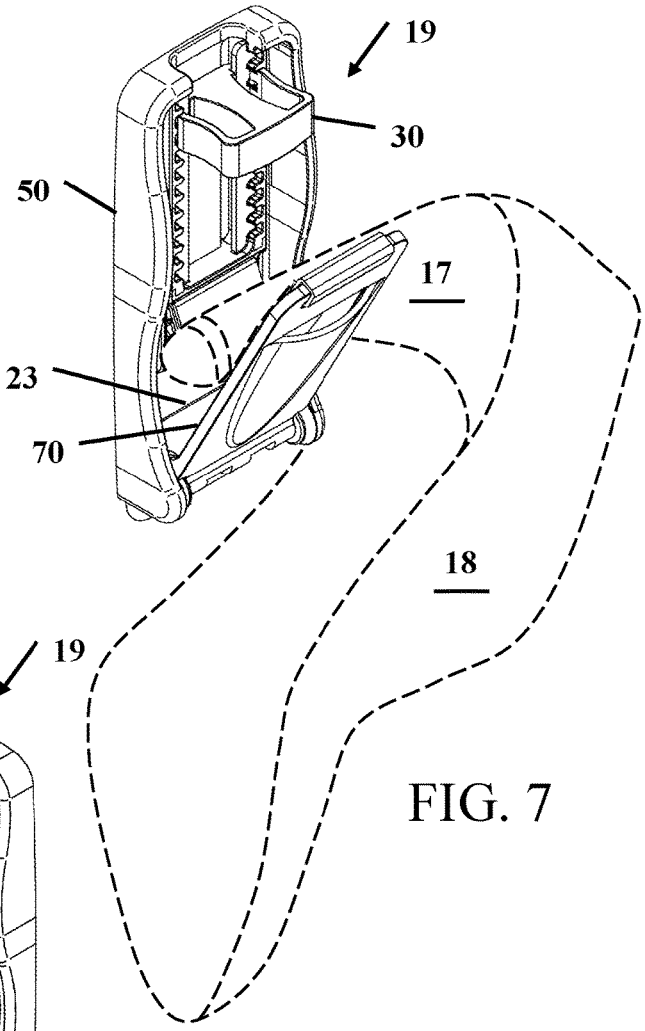
FIG. 7 shows a perspective view of the show holder organizer in a partially closed orientation with a shoe.

FIG. 6 shows a perspective view of the shows the holder organizer 19 in the closed orientation with the door 70 secured within the wall mount bracket 50. In this figure the heel 17 of a shoe 18 is supported on the cushion 30. FIG. 7 shows a perspective view of the shows the holder 19 in a partially closed orientation with a heel 17 a shoe 18 resting on the strap 23. It should be noted the different position of the cushion 30. In FIG. 6 the cushion 30 is on first end 21 of the strap 23.

Figure 8:
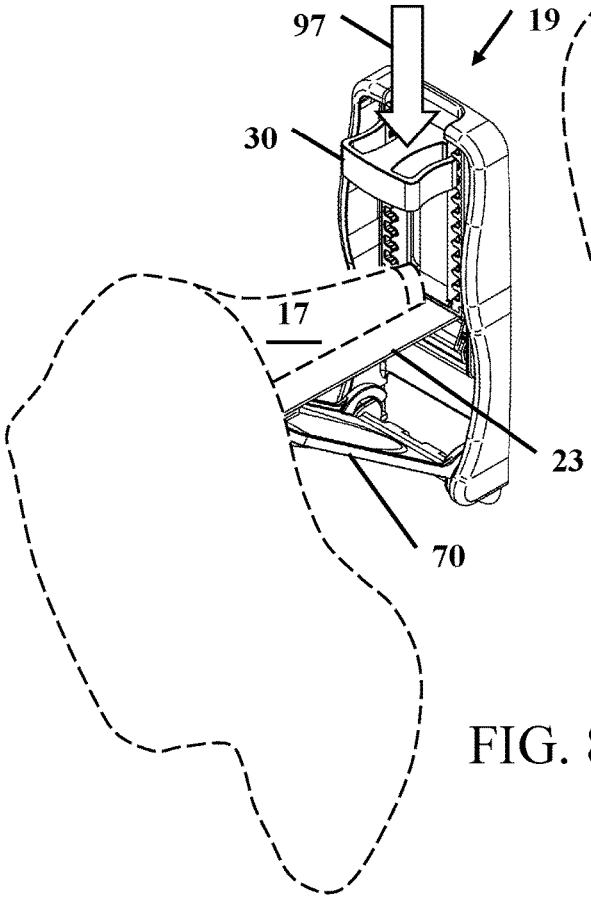
FIG. 8 shows a perspective view of the show holder organizer in the open orientation with a shoe.

FIG. 8 shows a perspective view of the shows the holder organizer 19 in the open orientation with the heel 17 of the shoe 18 resting on the stretched strap 23. The cushion 30 can then be brought down 97 onto the heel 17 of the shoe 18 to essentially lock the heel 17 between the cushion 30 and the strap 23. While these are two different orientations of securing a shoe 18 on the shoe holder organizer 19, other orientations are contemplated.

Thus, specific embodiments of a shoe holder have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A shoe holder organizer comprising:

a wall mount bracket that is configured to secure onto a wall, door or other flat surface;

a cushion secured onto the wall mount bracket;

a door that pivots on said wall mount bracket with a flexible strap that extends from said door to said wall mount bracket;

a free length of said flexible strap is adjustable by altering a wrap of said flexible strap through wrap tabs in said wall mount bracket;

said cushion is configured to move on said wall mount bracket, and wherein said shoe holder organizer is configured to retain at least one shoe thereon.

2. The shoe holder organizer according to claim 1, wherein said shoe holder organizer is configured to retain said at least one shoe between said cushion and said flexible strip.

3. The shoe holder organizer according to claim 1, wherein said shoe holder organizer is configured to retain said at least one shoe on said flexible strip.

4. The shoe holder organizer according to claim 1, wherein said at least one shoe is a high-heel shoe.

5. The shoe holder organizer according to claim 1, wherein the shoe holder organizer is configured to hold said at least one shoe in a closed position where a heel of said at least one shoe sits on said cushion.

6. The shoe holder organizer according to claim 1, wherein said cushion is configured to clamp said at least one shoe on said flexible strap when said door is pivoted in and open configuration.

7. The shoe holder organizer according to claim 1, wherein said flexible strap limits an angle of said door to pivot on said wall mount bracket.

8. The shoe holder organizer according to claim 1, wherein said wall mount further includes two columns of a plurality of teeth.

9. The shoe holder organizer according to claim 8, wherein said cushion includes a two flex arms where each of said two flex arm have tabs.

10. The shoe holder organizer according to claim 9, wherein said tabs are configured to engage in said plurality of teeth to limit movement of said cushion.

11. The shoe holder organizer according to claim 10, wherein said cushion is configured to clamp a heel of a shoe on said flexible strap.

12. The shoe holder organizer according to claim 9, wherein said two flex arms are bendable to disengage said tabs from said plurality of teeth.

13. The shoe holder organizer according to claim 1, wherein at least one side of said door has tab stops that are configured to temporally engage in detents in said wall mount bracket to retain said door in fixed positions.

14. The shoe holder organizer according to claim 1, further includes an adhesive wall mounting cushion.

15. The shoe holder organizer according to claim 14, further includes a pull strip wherein a user can release said adhesive wall mounting cushion from a wall.

16. The shoe holder organizer according to claim 1, wherein said flexible strap is removable from said shoe holder organizer.

17. The shoe holder organizer according to claim 1, wherein said flexible strap is configured to fold into said wall mount bracket behind said door.

18. The shoe holder organizer according to claim 1, wherein said door further includes a finger tab.

19. The shoe holder organizer according to claim 1, wherein said wall mount bracket and said door are configured to stretch said flexible strap in a horizontal orientation.

* * * * *